US006799542B2

(12) United States Patent
Pien

(10) Patent No.: US 6,799,542 B2
(45) Date of Patent: Oct. 5, 2004

(54) ENGINE HAVING PISTON-CAM ASSEMBLY POWERTRAIN

(76) Inventor: Pao C Pien, 840 S. Collier Blvd., Marco Island, FL (US) 34145

( * ) Notice: Subject to any disclaimer, the term of this patent is extended or adjusted under 35 U.S.C. 154(b) by 49 days.

(21) Appl. No.: 10/287,154

(22) Filed: Nov. 4, 2002

(65) Prior Publication Data

US 2004/0084007 A1 May 6, 2004

(51) Int. Cl.[7] ..... F02B 75/24
(52) U.S. Cl. ..... 123/53.5; 123/197.4; 74/53
(58) Field of Search ..... 123/197.1, 197.3, 123/197.4, 70 R, 53.1, 53.5, 58.1; 74/53, 54, 55

(56) References Cited

U.S. PATENT DOCUMENTS 1,267,547 A * 5/1918 Henry ..... 123/197.1
1,630,273 A * 5/1927 Nordwick ..... 123/197.1
1,730,659 A * 10/1929 Johnson et al. ..... 74/53
1,790,198 A * 1/1931 Vojetech ..... 74/55
1,955,976 A * 4/1934 Rasmussen ..... 123/70 R
3,482,554 A * 12/1969 Marthins ..... 123/197.1
4,381,739 A * 5/1983 Fisher ..... 123/197.1

* cited by examiner

*Primary Examiner*—Noah P. Kamen
(74) *Attorney, Agent, or Firm*—Whiteford, Taylor & Preston LLP; Gregory M. Stone; Jeffrey C. Maynard

(57) ABSTRACT

An engine having a piston-cam assembly powertrain consisting of a rocking yoke assembly that oscillates about its middle point to rotate a multiple-lobe cam. The mechanism is so constructed that cam followers at both ends of the oscillating yoke make contact with the surface of the multiple-lobe cam. When the rocking yoke is oscillated it causes rotation of the camshaft. Alternatively, the rotating cam can cause oscillation of the rocking yoke. The multiple-lobe cam is formed of two identical facing plates having sufficient width to provide an annular groove on the interior face of each plate. Such cam plates are spaced a sufficient width to accommodate the rocking yoke assembly between such cam plates with a pivoting bearing riding within such annular groove. Two connecting rods link the ends of the rocking yoke to two pistons within two parallel cylinders to form a piston-cam assembly powertrain. A number of rocking yoke assemblies consisting of two parallel cylinders can be arranged around the camshaft in rows and/or columns for obtaining required power output.

12 Claims, 3 Drawing Sheets

ENGINE HAVING PISTON-CAM ASSEMBLY POWERTRAIN

BACKGROUND OF THE INVENTION

1. Field of the Invention

The invention disclosed herein relates generally to a method and apparatus for converting linear reciprocating motion to rotary motion and vice-versa, and more particularly the present invention relates to a powertrain mechanism for converting reciprocating motion of a piston to rotary motion of a shaft and vice-versa.

2. Background of the Prior Art

Internal combustion engines, since the invention of such engines, have utilized a piston-crank mechanism as a basic power conversion mechanism of their powertrains. At the present time, a piston-crank mechanism is mostly used for such conversion. However, such mechanism requires a heavy connecting rod that, due to its lateral motion, generates piston side forces and complicated movement rendering engine balancing difficult. For a 4-stroke engine, a separate camshaft and associated gear train are required to operate inlet and exhaust valves. Various forms of piston-cam assembly powertrains have been introduced as an alternative to the piston-crank assembly powertrain. However, such piston-cam assembly powertrains have not achieved significant improvement over piston-crank assembly powertrains. Therefore, there remains a need for a piston-cam mechanism to convert linear reciprocating motion to rotary motion in a simple fashion while achieving reduction of shaft rotational speed without reduction gears.

SUMMARY OF THE INVENTION

It is an object of the invention to enable a piston-cam assembly powertrain that avoids the disadvantages of the prior art.

It is another object of the invention to provide an improved method and piston-cam assembly powertrain for converting the oscillating motion of a piston to the rotary motion of a shaft, and vice versa.

It is yet another object of the invention to provide a method for generating a multi-lobe cam profile for use in a piston-cam assembly powertrain.

It is still yet another object of the invention to provide a piston-cam assembly powertrain with fewer moving parts and less engine friction loss than previously known powertrains.

It is still even yet another object of the invention to provide a piston-cam assembly powertrain having no fixed connection between the connecting rods and the cam or cam shaft.

It is a further object of the invention to provide a piston-cam assembly powertrain that maintains the connecting rods in an orientation that substantially coincides with the centerline of its associated cylinder during the full stroke of the piston.

It is still yet a further object of the invention to provide a four-stroke engine that is operable without a separate camshaft and/or gear train to operate inlet and exhaust valves.

In accordance with the above objects, an improved method and piston-cam assembly powertrain are provided for converting the oscillating motion of a piston to the rotary motion of a shaft, and vice versa. A basic mechanism of the present invention consists of a rocking yoke assembly that oscillates about its middle point to rotate a multiple-lobe cam. The mechanism is so constructed that cam followers at both ends of the oscillating yoke make contact with the surface of the multiple-lobe cam. When the rocking yoke is oscillated it causes rotation of the camshaft. Alternatively, the rotating cam can cause oscillation of the rocking yoke. The multiple-lobe cam is formed of two identical facing plates having a gap between them defining an annular groove, the groove having sufficient width to accommodate the rocking yoke assembly between such cam plates with a pivoting bearing riding within such annular groove. Two connecting rods link cam followers at the ends of the rocking yoke to two pistons within two parallel cylinders to form a piston-cam assembly powertrain. A number of rocking yoke assemblies consisting of two parallel cylinders can be arranged around the camshaft in rows and/or columns for obtaining required power output.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
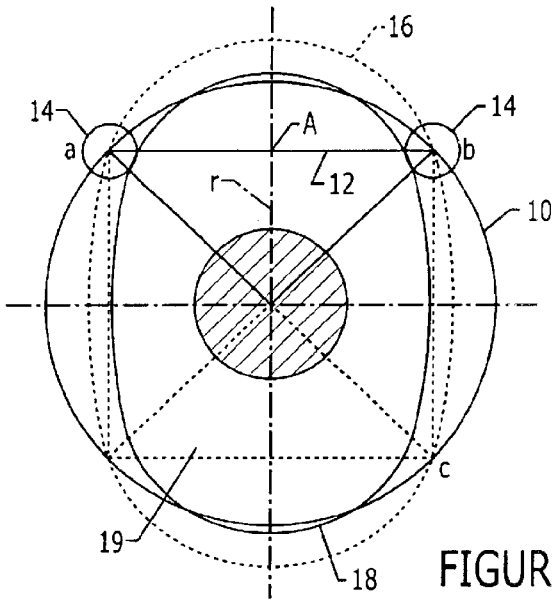
FIG. 1 illustrates a method for constructing a multiple-lobe cam profile.
Figure 1A:
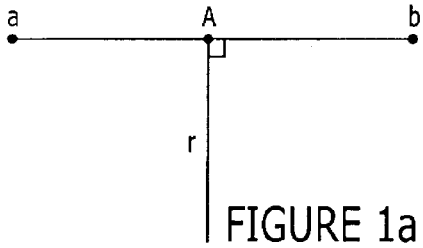
FIGS. 1*a*–1*c* show a schematic view of the oscillating cycle of a cord of a construction circle about its midpoint according to one aspect of the invention.
Figure 1B:
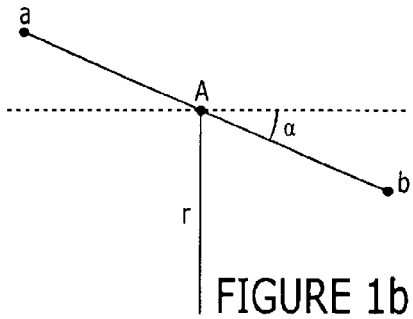
Figure 1C:
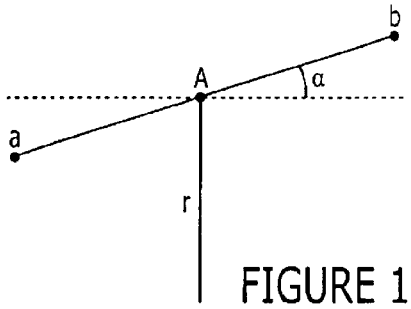

The present invention achieves a piston-cam assembly powertrain in two steps. The first step is to construct a multiple-lobe cam having a rocking yoke assembly; the second step is to link such rocking yoke assembly to a piston assembly. Referring to FIG. 1, a method for forming a multiple-lobe, and more particularly in the example of FIG. 1 a two-lobe, cam is illustrated. A construction circle 10 is drawn with a cord 12 as shown. Cord 12 subscribes an angle of 90 degrees at the center of construction circle 10, and its midpoint is positioned a distance away from the center of construction circle 10 equal to radius r. The midpoint of cord 12 is labeled point A. To establish the profile of a lobe, cord 12 oscillates about point A while point A rotates around the center of construction circle 10. As shown in FIGS. 1*a*–1*c*, the oscillating cycle of cord 12 may be described as the bi-directional rotation of cord 12 from its zero position (at which cord 12 is perpendicular to radius r, as shown in FIG. 1*a*), to a maximum angular displacement α away from the zero position (as shown in FIG. 1*b*), back through the zero position to a maximum angular displacement α in the opposite direction (as shown in FIG. 1*c*), and back to the zero position (FIG. 1*a*). In order to obtain the lobe profile, two paths are traced on the plane of construction circle 10 by the ends a and b, respectively of cord 12 as it oscillates about midpoint A as midpoint A in turn rotates about the center of construction circle 10.

The maximum angular displacement α may vary depending upon desired reciprocating piston motion in a piston-cam assembly powertrain, as will be discussed in greater detail below.

For a two-lobe cam profile, as point A travels 90 degrees clockwise around the center of construction circle 10, the cord oscillates about point A causing the leading end b of cord 12 to move toward the center of construction circle 10 and back to the circumference, while the lagging end a of cord 12 moves away from the center of construction circle 10 and back to the circumference. Cord 12 will reach a maximum angular displacement α when point A has rotated about 45 degrees clockwise, and will thereafter reverse its direction of rotation with respect to radius r as point A continues to rotate from 45 degrees to 90 degrees. After point A has rotated 90 degrees clockwise while cord 12 has completed half of an oscillating cycle (i.e., moved from the zero position of FIG. 1*a* to the maximum angular displacement position of FIG. 2*b*, and back to the zero position of FIG. 1*a*), leading and lagging ends of chord 12 have traced out imaginary cam profile sections b–c and a–b, respectively, on the plane of construction circle 10. As point A continues to rotate, and keeping the lagging end a on the track of the leading end b, the leading end traces out new profile sections until two identical imaginary lobes are obtained as shown by dotted line 16 of FIG. 1. The final cam profile 18 indicated by a solid line is derived from the imaginary cam profile 16 such that the gap between the solid line 18 and dotted line 16 is equal to the radius of roller cam followers 14.

For the two-lobe cam discussed above, cord 12 subscribes an angle of 90 degrees at the center of the construction circle 10. In the case of a three-lobe cam, cord 12 subscribes an angle of 60 degrees instead of 90 degrees. By following the same procedure, three identical lobe profiles are obtained. Generally, if the required number of lobes is N, the subscribed angle of the cord is 360 degrees divided by 2N. For one revolution of point A, the cord oscillates N cycles to obtain a cam with N lobes formed on the circumference of the construction circle. Thus, taking a three-lobe construction, the cord will oscillate through three full cycles for one revolution of point A to form the desired three-lobe cam profile.

A two-lobe cam 19 is constructed such that when cord 12 oscillates about its fixed middle point A, two cam followers 14 at both ends of cord 12 will cause the cam 19 to rotate.

Figure 2:
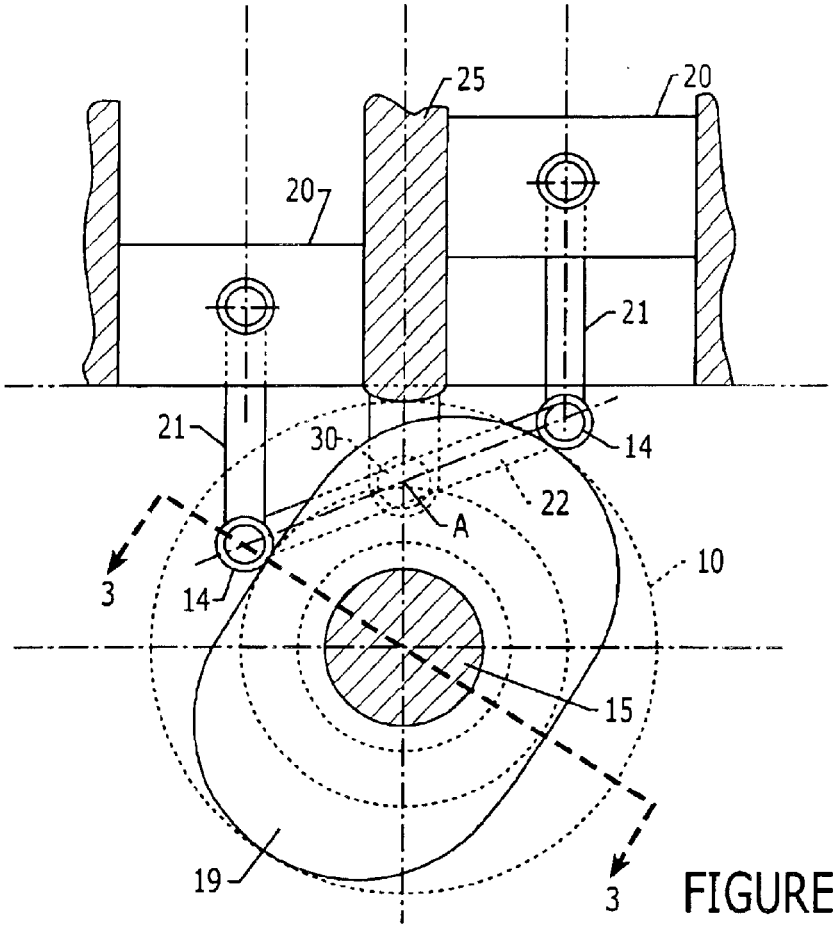
FIG. 2 shows a schematic view of a piston-cam assembly powertrain according to a preferred embodiment of the invention.

In the second step, as shown in FIG. 2, two cam follower rollers 14 in FIG. 1 are linked to two pistons 20 in two parallel cylinders by two connecting rods 21. Cord 12 becomes a rocking yoke 22 oscillating about point A fixed on cylinder block 25. From fixed pivoting point A, a radial line is drawn and two cylinder centerlines, parallel to the radial line, are drawn such that the path of travel of the two ends of the oscillating yoke, and thus the paths of travel of the lower ends of connecting rods 21, remain substantially parallel to the cylinder centerlines. While such connecting rods 21 may exhibit some slight deviation from the cylinder centerlines, such deviation is minimal and far less than previously known piston-cam assembly powertrains, as the cam followers 14 at the ends of the connecting rods 21 engage the cam 19 without a mechanical linkage therebetween.

Figure 4:
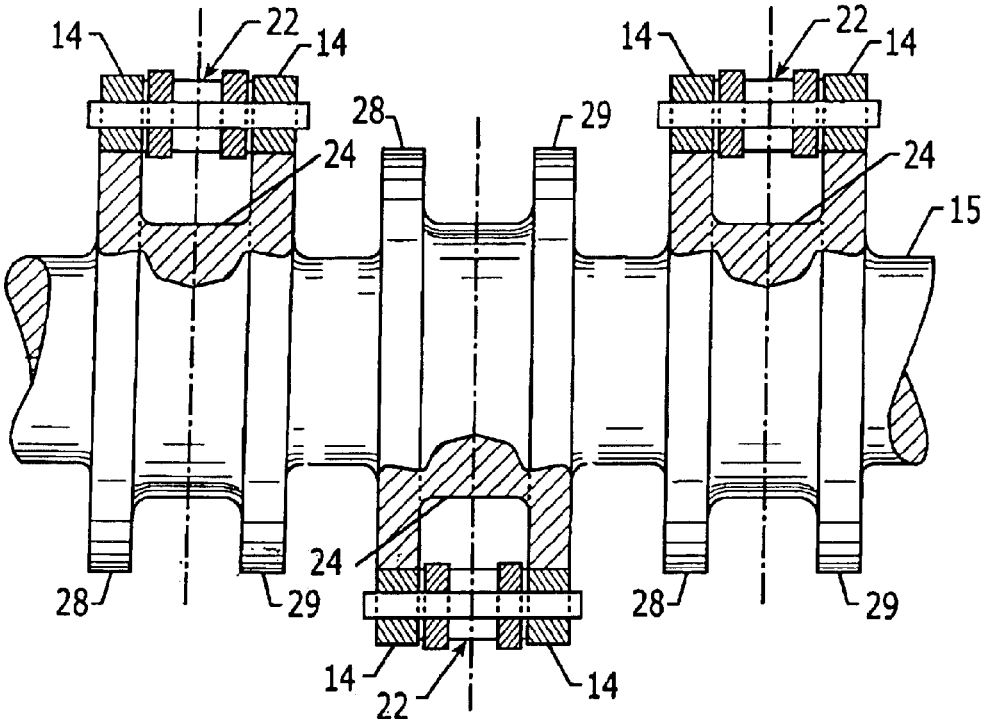
FIG. 4 shows a number of rocking yoke assemblies arranged on a single power output shaft according to one embodiment of the invention.

Two connecting rods 21 link cam followers at the ends of oscillating yoke 22 to two pistons 20 within two parallel cylinders to form a piston-cam assembly powertrain. The piston-cam assembly powertrain of one cylinder consists of a short light connecting rod 21, on half of rocking yoke 22 and two cam followers 14 linked by pins. As shown in FIG. 4, a number of rocking yoke units consisting of two parallel cylinders can be arranged around a camshaft in rows and/or columns for obtaining required power output. The piston-cam assembly powertrain so obtained has two separate parts; a rotary part including a member with a cam 19 drivingly connected to power output shaft 15, and a reciprocating part consisting of a rocking yoke assembly connected to a pair of pistons. The piston-cam assembly powertrain has only one rotary part, but may have several reciprocating units.

Figure 3:
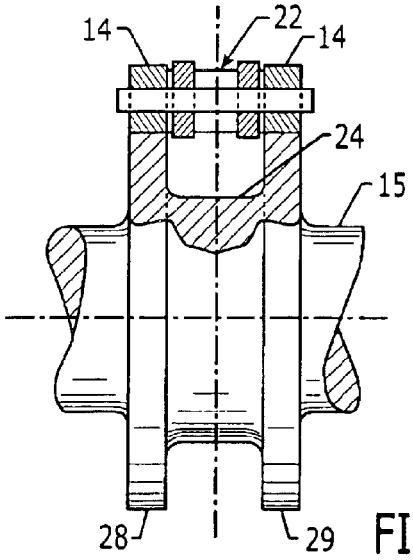
FIG. 3 is a sectional view along line 3—3 of FIG. 2.

FIG. 3 is a sectional view taken along line 3—3 in FIG. 2. The cam 19 formed on shaft 15 consists of a pair of facing plates 28, 29 forming two identical cam surfaces having the cam profile 18 described above. The plates 28 and 29 are spaced sufficiently to accommodate the rocking yoke 22. As shown in FIG. 2, a roller bearing 30 is centered at point A and is disposed in annular groove 24 defined by the space between plates 28 and 29. Two identical roller cam followers 14 are carried on both sides of the rocking yoke 22. Each roller cam follower 14 is configured to ride on the profile surface of cam 19.

As mentioned above, there is no linkage between the rotating and reciprocating parts of the piston-cam assembly powertrain. The rotating part, supported by two ball bearings, one at each end, can be balanced independently to perform additional functions of a flywheel. For each rotation of a two-lobe camshaft 15 (as shown in FIG. 2), the yoke 22 rocks back and forth twice while two pistons travel through four strokes in opposite directions. Two valve operating cams (not shown) can be fixed on the power output shaft without the need of a separate camshaft and associated gear train. With a large base circle and circular arc lobe profiles, intake and exhaust valves can open and close quickly to reduce engine pumping losses. Multiple yoke units can be arranged around a power output shaft in rows and/or columns to meet the total power requirement (as shown in FIG. 4).

As mentioned above, the oscillating amplitude of rocking yoke 22 (as indicated by maximum angular displacement α of yoke 22 from its zero position) determines the cam lobe height. Section a–b of the lobe profile of FIG. 1 can be freely chosen to obtain the desired reciprocating piston motion. This freedom adds another dimension to engine design. For instance, rocking yoke 22 can be momentarily stopped at top and bottom dead centers respectively. This would facilitate the scavenging process of a two-stroke engine and would allow inlet and exhaust valves to open before pistons start to move for a four-stroke engine. Maximum piston acceleration can be kept low by choosing an appropriate oscillating speed of rocking yoke 22.

Considering the cam 19 as a replacement for a flywheel, the piston-cam assembly powertrain of one cylinder consists of a short light connecting rod 21, one half of rocking yoke 22, and two cam follower rollers 14 linked by pins. Such piston-cam assembly powertrain not only converts a piston reciprocating motion to shaft rotary motion, but also achieves desired shaft rpm without reduction gears. Compared to an old piston-crank assembly powertrain, the new powertrain has less moving parts and far less engine friction losses. Double digits gain in mechanical efficiency and thus in fuel economy can be achieved by utilizing the new powertrain alone. Since the lower ends of such connecting rods follow a path of travel that remains substantially parallel to the cylinder centerlines, side forces between the piston and cylinder wall are negligibly small. Therefore a lighter piston with smaller bearing surface on the cylinder wall will reduce piston resistance permitting much higher piston speed to boost engine power density. Moreover such piston-cam assembly powertrain provides proper conditions for utilizing ceramic ring seal or other seal devices used in gas turbine engines instead of usual piston rings to prevent gas leakage across the piston. Without lubrication oil in cylinders, an air pump can deliver compressed air without being contaminated with oil. Such oil-free air pump has great application for food and pharmaceutical industries.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is my intention to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. An engine having a piston-cam assembly powertrain, said piston-cam assembly powertrain further comprising:

a rotary part and a reciprocating part, a. said rotary part comprising:

(i) a first cam plate and a second cam plate, wherein said first and said second cam plates are drivingly connected to a power output shaft a sufficient distance apart to define an annular groove therebetween; wherein (ii) said first and second cam plates present identical cam surfaces; and b. said reciprocating part comprising:

(i) a rocking yoke having a first end and a second end positioned between said first and second cam plates, said rocking yoke being pivoted at a point between said first end and said second end;

(ii) a first cam follower connected to said rocking yoke at said first end and a second cam follower connected to said rocking yoke at said second end, said cam followers being in contact with said cam surface of said rotary part;

(iii) a first connecting rod connecting said first cam follower to a first piston reciprocating in a first cylinder and a second connecting rod connecting said second cam follower to a second piston reciprocating in a second cylinder, said first cylinder and said second cylinder being parallel to each other; wherein said reciprocating pistons cause oscillation of said cam followers to rotate said power output shaft.

2. The engine claim 1, wherein said rocking yoke is pivoted at a middle point between said first end and said second end.

3. The engine claim 1, wherein said rocking yoke is pivotally attached to a cylinder block containing said first and second cylinders.

4. The engine claim 1, wherein said rocking yoke is positioned so that oscillating ends of said rocking yoke result in a path of travel of a lower end of each of said connecting rods remaining substantially parallel to the centerlines of said cylinders during the stroke of said pistons.

5. The engine of claim 1, further comprising:

a bearing located at said pivoting point on said rocking yoke, positioned so that said bearing fits in said annular groove.

6. The engine of claim 1, said rocking yoke further comprising a pair of cam followers attached to each side of said first and second end of said rocking yoke, wherein:

said pair of cam followers are in contact with said cam surface of said cam surface of said first and second cam plates.

7. The engine of claim 6, wherein said cam followers lack a mechanical linkage to said cam.

8. The engine claim 1, wherein said rotary part and said reciprocating part are repeated on said power output shaft to accommodate a plurality of said rocking yokes required for total power output.

9. The engine claim 8, wherein said plurality of rocking yokes is arranged around said power output shaft in rows.

10. The engine of claim 8, wherein said plurality of rocking yokes is arranged around said power output shaft in columns.

11. A method for obtaining the cam surface of claim 1 having N lobes, the method comprising the steps of:

a. forming a construction circle;

b. drawing a chord across said construction circle subscribing an angle of 360/2N degrees at the center of said construction circle;

c. oscillating said chord about its middle point through a first half of a bi-directional rotation cycle while rotating said middle point around said construction circle center through 360/2N degrees, the lagging end of said oscillating chord tracing a section of a lobe profile while the leading end of said oscillating cord tracing another section of a lobe profile on the plane of said construction circle;

d. oscillating said chord about its middle point through another half of a bi-directional rotation cycle while rotating said middle point around said construction circle center through next 360/2N degrees, the leading end of said oscillating chord tracing an additional lobe profile section while the lagging end of said oscillating chord is kept on the track of the leading end to guide the leading end;

e. repeating step d to trace additional cam profile lobes until said middle point has been rotated around said construction circle by a total of 360 degrees; and f. drawing a cam profile derived from said profile lobes generated from steps c–e such that said cam profile is uniformly smaller than said first and second profile lobes equal to the radius of said cam followers.

12. An engine having a cam surface obtained by the method of claim 11, wherein rotation of said power output shaft is equal to the number of piston reciprocating cycles divided by N.

* * * * *